United States Patent [19]

Zumwalt

[11] Patent Number: 4,541,158

[45] Date of Patent: Sep. 17, 1985

[54] PISTON AND CONNECTING ROD REMOVING AND INSTALLATION TOOL

[76] Inventor: Floyd A. Zumwalt, Rte. 2, Box 133, McMinnville, Oreg. 97128

[21] Appl. No.: 510,757

[22] Filed: Jul. 5, 1983

[51] Int. Cl.[4] ..... B25B 27/02

[52] U.S. Cl. ..... 29/278; 29/283

[58] Field of Search ..... 29/270, 275, 278, 276, 29/283

[56] References Cited

U.S. PATENT DOCUMENTS

| | | | |
|---|---|---|---|
| 2,431,713 | 12/1947 | Stigler | 29/278 |
| 2,508,047 | 5/1950 | Starnes | 29/278 |
| 2,557,611 | 6/1951 | Myers | 29/283 |
| 2,610,391 | 9/1952 | Gorton | 29/278 |
| 2,687,568 | 8/1954 | Keiser | 29/278 |
| 3,319,326 | 5/1967 | Unglesby | 29/283 X |

*Primary Examiner*—Frederick R. Schmidt
*Assistant Examiner*—Steven P. Schad
*Attorney, Agent, or Firm*—James D. Givnan, Jr.

[57] ABSTRACT

A hand tool for engagement with a partially disassembled engine connecting rod with the tool having a handle-shaped base having a channel within which angular arm members are slidably and lockably mounted. Each arm member includes an extension defining a socket for reception of a connecting rod bolt. The sockets are off-center to provide variable spacing of the sockets upon rotational positioning of the extension on its supporting arm member. A modified base of the tool provides a concave surface against which an engine crankshaft may be biased to utilize the crankshaft in a piston and connecting rod removing operation. Arm members diverge slightly for purposes of providing inherent biased engagement with connecting rod bolts.

7 Claims, 8 Drawing Figures

PISTON AND CONNECTING ROD REMOVING AND INSTALLATION TOOL

BACKGROUND OF THE INVENTION

The present invention relates generally to tools used in the repairing of internal combustion engines and particularly to a tool for use in removing pistons and connecting rods from a full range of engine block sizes.

The prior art discloses hand tools for temporary attachment to a partially disassembled connecting rod for applying upward force for rod and piston removal from an engine block. Substantial forces are required for such removal in some instances but such forces must be carefully applied in order that engine surfaces are not damaged.

U.S. Pat. Nos. 2,610,391 and 2,557,611 are of interest in that the former shows a hand held tool having arm members with sockets in their ends to receive the connecting rod studs exposed by the removal of the rod cap. No provision is made for adapting the tool to a wide range of crankshaft journal diameters or rod stud spacing variances. The latter U.S. patent is of interest in that provision is made for utilizing crankshaft rotation to bias the tool, connecting rod and piston in one direction. For one or more reasons and to the best of the present inventor's knowledge, neither of the prior art tools are in wide use at present. U.S. Pat. No. 2,687,568 shows an adjustable tool for pulling repaired rods and pistons into an engine block.

SUMMARY OF THE PRESENT INVENTION

The present invention is embodied within a tool for engine repair which is readily adaptable to connecting rod and piston removal from most all common engine configurations.

The tool includes a base having a handle and on which are mounted a laterally adjustable pair of arms. Arm extentions may accordingly be spaced to pass in a precise manner past the crankshaft journal to engage endwise both the partially disassembled crankshaft and the bearing half held therein. The arm extensions are rotatable to locate off-center sockets therein for stud reception. The arm extensions are readily detachable to enable use of modified extensions. Further, a modified handle of the tool enables use of the engine crankshaft to impart outward, axially directed forces to a piston.

Important objectives include the provision of an engine repair tool for use in removing connecting rods and pistons from a wide range of engine sizes including both gasoline and diesel engines; the provision of a hand tool which may be readily adapted to the job at hand by reason of adjustable arm members and adjustable arm extensions, the latter preferably having off-center sockets for bolt reception; the provision of a tool which has inherent flexibility in its arm members to cause same to laterally engage and retain the connecting rod bolts against slippage within the extension sockets; the provision of a tool lending itself to production by high volume, low cost molding operations; the provision of a piston and connecting rod removal tool which may utilize manually exerted or crankshaft exerted forces during use; the provision of a tool which incurs minimal die costs by reason of one die being used for both arm members and one die for both arm estensions.

DETAILED DESCRIPTION OF THE PREFERRED EMBODIMENT

Figures 1, 2, 3, 4, 5, 6, 7, 8:
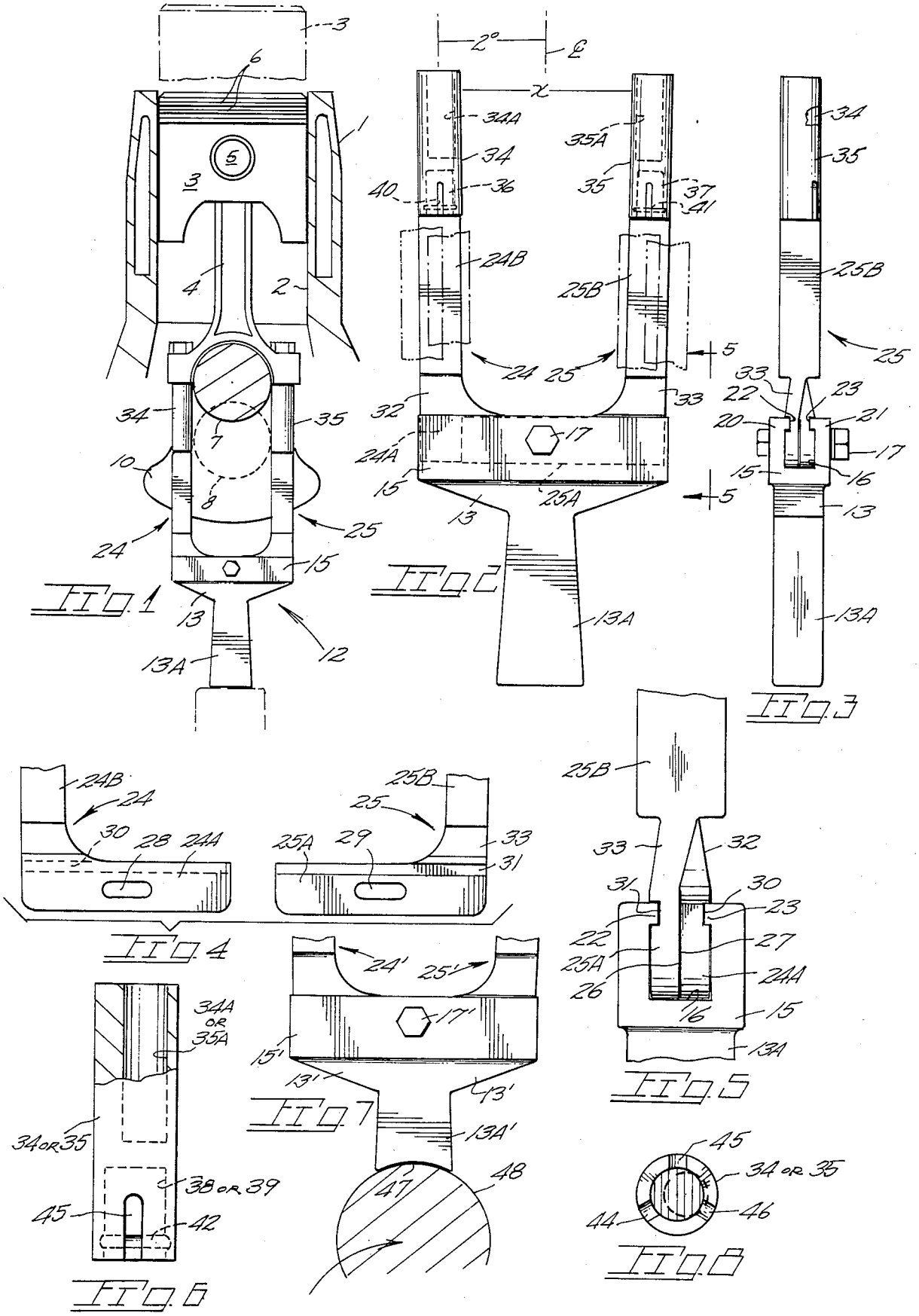
FIG. 1 is a front elevational view of the present tool coupled to the lower end of a partially disassembled connecting rod.
FIG. 2 is an enlarged front elevational view of the tool with arm members shown in laterally adjusted, broken line positions.
FIG. 3 is a side elevational view of FIG. 2.
FIG. 4 is a fragmentary front elevational view of the tool arm members removed from the tool base and spaced from one another.
FIG. 5 is an enlarged vertical elevational view taken along line 5—5 of FIG. 2.
FIG. 6 is a side elevational view of an arm member extension.
FIG. 7 is a fragmentary front elevational view of a modified tool base.
FIG. 8 is a bottom plan view of FIG. 6.

With continuing attention to the drawing wherein applied reference numerals indicate parts similarly hereinafter identified, the reference numeral 1 indicates the block of an internal combustion engine which typically defines a number of cylinders one of which is shown at 2.

A piston at 3 is joined to a connecting rod 4 by a wrist pin at 5. A set of piston rings are at 6 which along with the piston and cylinder wall provide resistance to the upward removal of the piston during an engine overhaul.

A connecting rod crankshaft journal is indicated at 7 while a main journal of the crankshaft is at 8. A crankshaft counter balance is at 10. The foregoing is intended to be more or less typical of current engine construction.

With attention now to the present tool, the same is indicated generally at 12 and includes a base 13 having a depending portion 13A which constitutes a handle in the preferred form of the invention. Crosswise to handle portion 13A is arm mounting structure at 15 which, as illustrated in FIG. 3, defines an upwardly opening channel 16.

Locking means shown as a fastener assembly 17 extends through said arm mounting structure to exert a clamping action on following described arm members. Flanges at 20 and 21 of the channel defining structure may be displaced to some degree to effect a clamping action under the influence of fastener assembly 17. Flanges 20 and 21 terminate upwardly in opposed, inwardly directed shoulders at 22 and 23.

Tool arm members, generally at 24 and 25, are each of generally right angular configuration having channel insertable segments at 24A-25A and upstanding segments at 24B and 25B. The arms are jointly and slidably received within the base defined channel 16 and therein secured by fastener assembly 17.

The arm members may be identical having abutting surfaces at 26 and 27. Grooves at 30 and 31 in each arm member slidably engage the opposed shoulders 22 and 23 on the base to further assure retention of said arm members against laterally and axially exerted loads. Canted arm portions at 32 and 33 serve to locate upright arm segments 24B-25B in a common vertical plane as best viewed in FIG. 5. Elongate arm openings 28 and 29 permit passage of fastener assembly 17. Per FIG. 2, the arm member segments 24B-25B and their extensions at 34-35 diverge outwardly two degrees or so from a tool centerline CL. At the upper end of each arm segment is an arm extension at 34 and 35 (FIG. 6) each of which defines an upwardly opening socket at 34A-35A for the reception of threaded shanks of connecting rod bolts. Male-female coupling means are embodied in arm projections at 36 and 37 which seat within downwardly directed openings 38 and 39 within the lower end of each arm extension. To assure against accidental separation, each arm projection 36 and 37 is provided with an annular shoulder as at 40 and 41 which occupies an annular recess as at 42 in each arm extension. Radial flexing of the extension walls is facilitated by circumferentially spaced apart slots 44, 45 and 46.

With attention again to the bolt receiving sockets 34A-35A of the arm extensions, the same are preferably assymetrical with respect to each extension axis. Rotation of one or both extensions about their respective arm member projection 36 or 37 enables precise spacing of the extension sockets to receive the connecting rod bolts throughout a range of connecting rod sizes. In conjunction with this spacing feature is the capability of the arm members to be laterally adjusted and clamped within the base channel per the single dot and double dot broken line positions of FIG. 2 which are intended to be explanatory only and are not illustrative of the full range of arm spacing.

In FIG. 7, I show a modified base at 13' wherein a depending portion 13A' terminates in a concave surface 47 which may be engaged by a crankshaft journal 48 during rotation of same to impart an upward force on the tool and the lower end of a partially disassembled connecting rod as earlier described.

One satisfactory embodiment of the tool provides a base channel structure of about four and one-half inches in length. The arm members and their extensions extend jointly about six inches from the upper extremity of the base flanges. Dimension x in FIG. 2 may be varied by arm positioning within the base defined channel with such opening ranging from one and one-half inches to two and thirteen sixteenths of an inch to enable the extensions 34 and 35 to be positioned tangentially to a crankshaft connecting rod journal so as to upwardly engage the machined surfaces of the connecting rod as well as the coplanar ends of a bearing shell housed in the connecting rod to hold the latter in the connecting rod during tool use. The bolt receiving sockets formed in each arm extension may be of one-half inch diameter with their centers offset from the extension center by 0.035 thousandths enabling additional adjustment capability by rotation of one or both extensions. The friction tight fit of each extension on its respective arm member projection permits rotational manual positioning by the extensions while preventing inadvertent rotation of the extensions during tool use.

One suitable material for the tool is DuPont nylon ST801 or ST901.

In use, whether displacing a worn piston and rod upwardly from a cylinder or drawing a refurbished piston and rod downwardly into a cylinder, the arm members are gripped and displaced inwardly into a parallel relationship whereupon the extension sockets may receive the connecting rod bolts. Release of the arm members permits same to tend to return to their diverging position resulting in lateral engagement of each extension with the threaded shank of the bolt therein. Accordingly, axially directed forces may be exerted on the connecting rod in either direction with the crankshaft journal at all times protected from the bolt threads.

While I have shown but a few embodiments of the invention it will be apparent to those skilled in the art that the invention may be embodied still otherwise without departing from the spirit and scope of the invention.

Having thus described the invention, what is claimed and desired to be secured under a Letters Patent is:

1. A tool for removing a piston and partially disassembled connecting rod with connecting rod bolts from an engine block, said tool comprising, a base including a handgrip and arm mounting structure defining an upwardly opening channel extending normal to said handgrip, right angular arm members having channel insertable segments adjustably mounted in said channel, means locking said arms top an adjusted laterally spaced apart position to said base whereby spaced segments of said arm members are substantially parallel with one another, arm extensions one each carried by said arm members and each defining a socket for the reception of an end segment of a connecting rod bolt, said right angular arm members each having a manually displaceable upright arm segment with the upright arm segments normally being in slightly outwardly diverging relationship with one another and adapted for manual displacement into parallel relationship for engagement with parallel connecting rod bolts with subsequent manual release of the upright arm segments permitting same to laterally engage said bolts, and coupling means removably coupling each of said extensions to an upright arm segment.

2. The tool claimed in claim 1 wherein said arm extension sockets are formed off-center within their extension, said coupling means permitting arm extension rotation about the arm extension major axis whereby each of said sockets may be adjusted into an off-center relationship with its arm member to accommodate a range of differently spaced connecting rod bolts.

3. The tool claimed in claim 2 wherein said coupling means includes male and female components, said arm extensions defining axially extending slotted areas to enable momentary expansion of the extension during attachment to its arm member.

4. The tool claimed in claim 3 wherein one of said components includes an annular ridge for extension retention.

5. The tool claimed in claim 1 wherein said arm members and said arm mounting structure include cooperating shouldered and grooved portions for arm member retention.

6. The tool claimed in claim 5 wherein said locking means is a threaded fastener assembly which upon tightening causes the channel defining portion of said arm mounting structure to exert a clamping force on said arm members.

7. The tool claimed in claim 1 wherein said right angular arm members each include canted arm portions which permit upright arm segments to be in a common vertical plane.

* * * * *